US006468197B1

(12) United States Patent
Lencoski et al.

(10) Patent No.: US 6,468,197 B1
(45) Date of Patent: Oct. 22, 2002

(54) CUSHIONING CONVERSION MACHINE WITH SEVERING MECHANISM

(75) Inventors: Michael Lencoski, Claridon Township; Richard O. Ratzel, Westlake; James A. Simmons, Painseville Township, all of OH (US)

(73) Assignee: Ranpak Corp., Concord Township ( * ) Notice: Subject to any disclaimer, the term of this patent is extended or adjusted under 35 U.S.C. 154(b) by 769 days.

(21) Appl. No.: 08/676,681

(22) Filed: Jul. 10, 1996

(51) Int. Cl.[7] ..... B31B 1/00

(52) U.S. Cl. ..... 493/464; 493/357; 493/440; 83/614

(58) Field of Search ..... 493/357, 440, 493/346, 464; 83/614, 630, 633

(56) References Cited

U.S. PATENT DOCUMENTS

| | | | |
|---|---|---|---|
| 4,026,198 | A | 5/1977 | Ottaviano |
| 4,109,040 | A | 8/1978 | Ottaviano |
| 4,619,635 | A | 10/1986 | Ottaviano |
| 4,650,456 | A | 3/1987 | Armington |
| 4,699,609 | A | 10/1987 | Komaransky et al. |
| 4,717,613 | A | 1/1988 | Ottaviano |
| 4,750,896 | A | 6/1988 | Komaransky et al. |
| 4,968,291 | A | 11/1990 | Baldacci et al. |
| 5,123,889 | A | 6/1992 | Armington et al. |
| 5,322,477 | A | 6/1994 | Armington et al. |
| 5,442,983 | A | 8/1995 | D'Angelo et al. |

*Primary Examiner*—Joseph J. Hail, III
*Assistant Examiner*—Anthony Ojini
(74) *Attorney, Agent, or Firm*—Renner, Otto, Boisselle & Sklar, LLP

(57) ABSTRACT

A cushioning conversion machine for converting sheet-like stock material into a relatively low density cushioning dunnage product. The machine has at least one conversion assembly for forming the stock material into a three-dimensional shape. The machine includes a feed mechanism for drawing the stock material over a shaping member in the conversion assembly. Any one of a plurality of manually operated severing mechanisms can be mounted in the second unit for cutting the cushioning dunnage product into cut sections. One severing unit has a circular cutting disc which is driven by a rack and pinion faster than rolling contact along a reaction member. Another severing mechanism has a fixed blade with an inclined cutting edge that moves across the path of the converted material. A third mechanism has straight edged blade that moves on vertical tracks downward through the path of the emerging converted material to sever the material against a fixed reaction member. Another mechanism has a taught wire which can be pulled through the converted material. A reaction bar with a slot is located on one side of the path of the material and the wire is pulled up through the slot, trapping and then severing the material. In another mechanism, a pair of blades with serrated edges are mounted for vertical movement in a plane transverse to the path of the converted material, the blades are driven in a reciprocating motion a by a pair of out of phase zigzag cams and a cam follower attached to each of the blades.

30 Claims, 18 Drawing Sheets

CUSHIONING CONVERSION MACHINE WITH SEVERING MECHANISM

FIELD OF THE INVENTION

The invention herein described relates generally to cushioning conversion machines and more particularly to improvements in the mechanisms for cutting cushioning materials formed by such machines.

BACKGROUND OF THE INVENTION

In the process of shipping an item from one location to another, protective packaging material is often placed in the shipping container to fill any voids and/or to cushion the item during the shipping process. Some commonly used protective packaging materials are plastic foam peanuts and plastic bubble pack. While these conventional plastic materials seem to perform adequately as cushioning products, they are not without disadvantages. Perhaps the most serious drawback of plastic bubble wrap and plastic foam peanuts is their effect on our environment. Quite simply, these plastic packaging materials are not biodegradable, and therefore they cannot avoid further multiplying our planet's already critical waste disposal problems. The non-biodegradability of these packaging materials has become increasingly important in light of many industries adopting more progressive policies in terms of environmental responsibility.

The foregoing and other disadvantages of conventional plastic packaging materials have made paper protective packaging material a very popular alternative. Paper is biodegradable, recyclable and composed of a renewable resource; making it an environmentally responsible choice for conscientious shippers.

While paper in sheet form could possibly be used as a protective packaging material, it is usually preferable to convert the sheets of paper into a relatively low density pad-like cushioning or dunnage product. This conversion may be accomplished by a cushioning conversion machine, such as that disclosed in commonly assigned U.S. Pat. No. 5,123,889. The conversion machine disclosed in U.S. Pat. No. 5,123,889 converts sheet-like stock material, such as paper in multiply form, into relatively low density pads. Specifically, the machine converts this stock material into a continuous unconnected strip having lateral pillow-like portions separated by a thin central band. This strip is coined along its central band to form a coined strip which is cut into sections, or pads, of a desired length. The stock material preferably consists of three superimposed webs or layers of biodegradable, recyclable and reusable thirty-pound Kraft paper rolled onto a hollow cylindrical tube. A thirty-inch wide roll of this paper, which is approximately 450 feet long, weighs about 35 pounds and will provide cushioning equal to approximately sixty cubic feet of plastic foam peanuts while at the same time requiring less than one-thirtieth the storage space.

The converting machines known in the prior art, including the one shown in U.S. Pat. No. 5,123,889, have utilized a guillotine type cutter to sever the coined strip into sections of the desired length.

SUMMARY OF THE INVENTION

The present invention provides an improved cutter mechanism for cushioning conversion machine which is able to sever a converted strip of cushioning in an efficient and effective manner. In one embodiment of the present invention the cutting mechanism includes a rotating, circular blade mounted for movement along a track which is transverse to the path of the converted strip of cushioning through the machine. The blade preferably is driven by an attached gear which engages a fixed rack. As the blade traverses the paper path, the cutting edge turns faster than rolling contact, causing a severing action.

In a second embodiment, the cutting mechanism includes a knife mounted for movement along a track which is transverse to the path of the converted strip of cushioning though the machine. The cutting edge of the knife is slanted, and the tip of the blade rides in a slot which is parallel to and below the track. As the knife is drawn across the paper, the sharp edge presses the paper downward toward the slot until there is enough pressure to force the knife through the paper severing the strip into sections of the desired length.

In a third embodiment, a wire is positioned below the path of the converted strip of cushioning through the machine. A shearing bar which includes a lengthwise slot is positioned above the path of the converted strip of cushioning through the machine. The wire can be lifted through the slot by a pair of hooks which extend through the slot and straddle the strip. When first one hook and then the other are lifted, the sharp, thin wire shears the paper as the wire passes through the slot.

In a fourth embodiment, the cutting mechanism includes an opposed pair of knife edges, one of which is mounted for vertical movement across the path of the strip of converted paper through the machine, and the other of which is fixed below the path of the strip. A lever, crank and connecting rod actuate the moveable knife edge and bring it into forceful contact with the fixed blade to sever the strip of paper.

In a fifth embodiment, the cutting mechanism includes a pair of serrated blades mounted side-by-side. The blades are movable along vertical tracks located on opposite sides of the path of the converted strip through the machine. Each track also includes a zigzag cam which engages and drives a cam follower connected with one of the blades. The cams are positioned so that the blades oscillate with respect to each other as they move downward through the converted strip.

These cutting mechanisms are used as part of a cushioning conversion machine which converts sheet-like material into a relatively low density cushioning dunnage product. A preferred machine comprises initial and subsequent units having separate housings. The initial unit includes in the housing thereof a shaping member over which the sheet-like stock material is drawn to form the stock material into a three-dimensional shape. The subsequent unit includes in the housing thereof a feed mechanism for drawing the stock material over the shaping member of the initial unit. The housings of the initial and subsequent units respectively have an outlet opening and an inlet opening relatively positionable with respect to one another to provide a pathway for transfer of the sheet-like material from the initial unit to the subsequent unit. The cutting mechanism is mounted in the subsequent unit for cutting the cushioning dunnage product into cut sections.

The present invention provides the foregoing and other features hereinafter fully described and particularly pointed out in the claims, the following description and annexed drawings setting forth in detail certain illustrative embodiments of the invention, these embodiments being indicative, however, of but a few of the various ways in which the principles of the invention may be employed.

DETAILED DESCRIPTION

Figure 1:
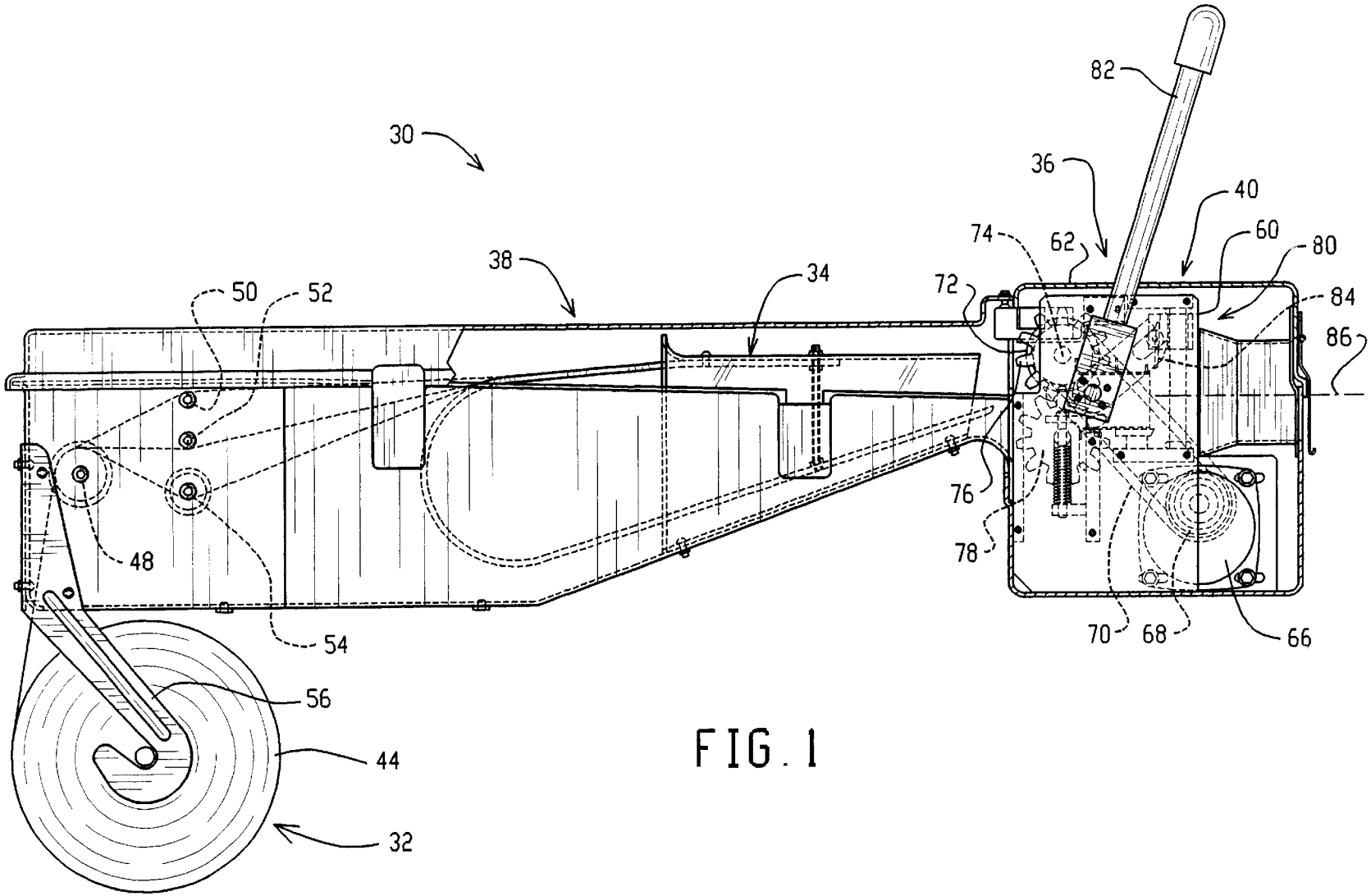
FIG. 1 is a side elevational view of a cushioning dunnage conversion machine constructed in accordance with the teachings of U.S. patent application Ser. No. 08/486,811.

FIG. 1 illustrates a cushioning conversion machine 30 constructed in accordance with U.S. patent application Ser. No. 08/486,811. The conversion machine 30 includes a stock supply assembly 32, a forming assembly 34, and a feed/connecting and cut-off assembly 36, the latter hereinafter also being more simply referred to as the feed and cut assembly. In the illustrated machine, the stock supply assembly 32 and forming assembly 34 are associated with a former unit 38 while the feed/connecting and cut-off assembly are associated with a head unit 40, this being similar to the arrangement described in U.S. patent application Ser. No. 08/486,811, which is hereby incorporated herein by reference in its entirety.

In use, the conversion machine 30 processes sheet-like stock material to form dunnage which may be used for packing or shipping purposes. The sheet material may consist of two, three, or more superimposed plies or layers of biodegradable, recyclable, and reusable paper, for example 30 or 50 pound Kraft paper, which may be supplied in a roll 44 or otherwise. The illustrated conversion machine 30 converts this stock sheet material into a continuous strip of cushioning with lateral pillow-like portions separated by a thin central band. This strip is "connected" as by coining along the central band and may be cut into sections of a desired length.

The stock supply assembly 32 may include a constant entry roller 48 and various bars or rollers 50, 52, and 54 for separating the layers of sheet material before being fed into the forming assembly 34. The stock supply assembly 32 may also include a holder 56 which may support a roll of sheet material. Alternatively, the sheet material may be fed directly to the roller 48 from a separate stand holding the sheet material, or by other suitable means.

The forming assembly 34 is similar to that shown in the aforesaid U.S. patent application Ser. No. 08/486,811. As the sheet material passes through the forming assembly 34, it is formed into a continuous unconnected strip. While the forming assembly 34 is preferably like that shown in the above-mentioned U.S. patent application Ser. No. 08/486, 811, other forming assemblies are also usable in the practice of the present invention. Reference also may be had to said application for further details of the illustrated former unit 38.

The head unit 40 includes a frame 60 to which the various components of the feed and cut assembly 36 are mounted. The head unit preferably has an outer casing or shell 62 enclosing the various components of the feed and cut assembly. The former unit may be connected to the head unit in the manner illustrated in the aforesaid '811 application.

The feed and cut assembly 36 includes a motor 66 fastened to the frame 60. The shaft of the motor 66 drives an output sprocket 68. The sprocket 68 drives a chain 70 which in turn drives sprocket 72. The sprocket 72 in turn is mounted to a shaft 74 which carries an upper coining gear 76. The upper coining gear 76 is in constant mesh with a lower coining gear 78. When the strip of paper exits the forming assembly 34, it passes between the upper and lower coining gears 76 and 78 which secure a centrally located axially extending portion of the strip to hold it together, all in a manner well known in the art.

The feed and cut assembly 36 further includes a severing mechanism 80 to sever the emerging dunnage into strips of the desired length. The severing mechanism 80 is controlled by a manually operated handle 82 which is connected through a linkage to a vertically movable blade 84. When the handle 82 is pulled downward and to the right (clockwise as viewed in FIG. 1), the blade 84 moves downward across the path 86 of the converted sheet material to sever the emerging strip at the desired location. The handle may also be used to control the feeding of stock material through the machine as in the manner described in the '811 application.

Figure 2:
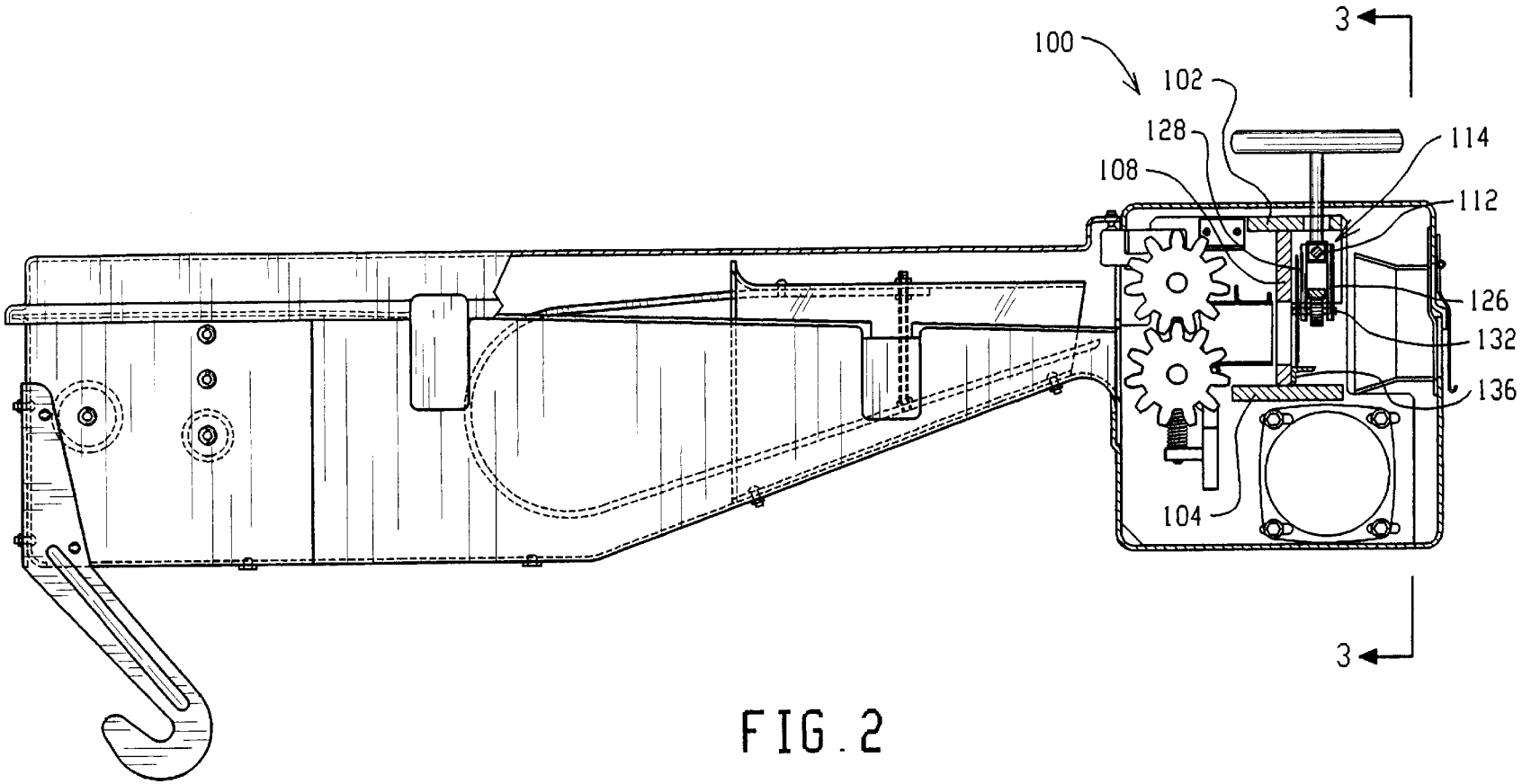
FIG. 2 is a side elevational view of a first embodiment of the present invention showing a circular blade mounted for movement along a track which is transverse to the path of the converted strip of cushioning through the machine.
Figure 3:
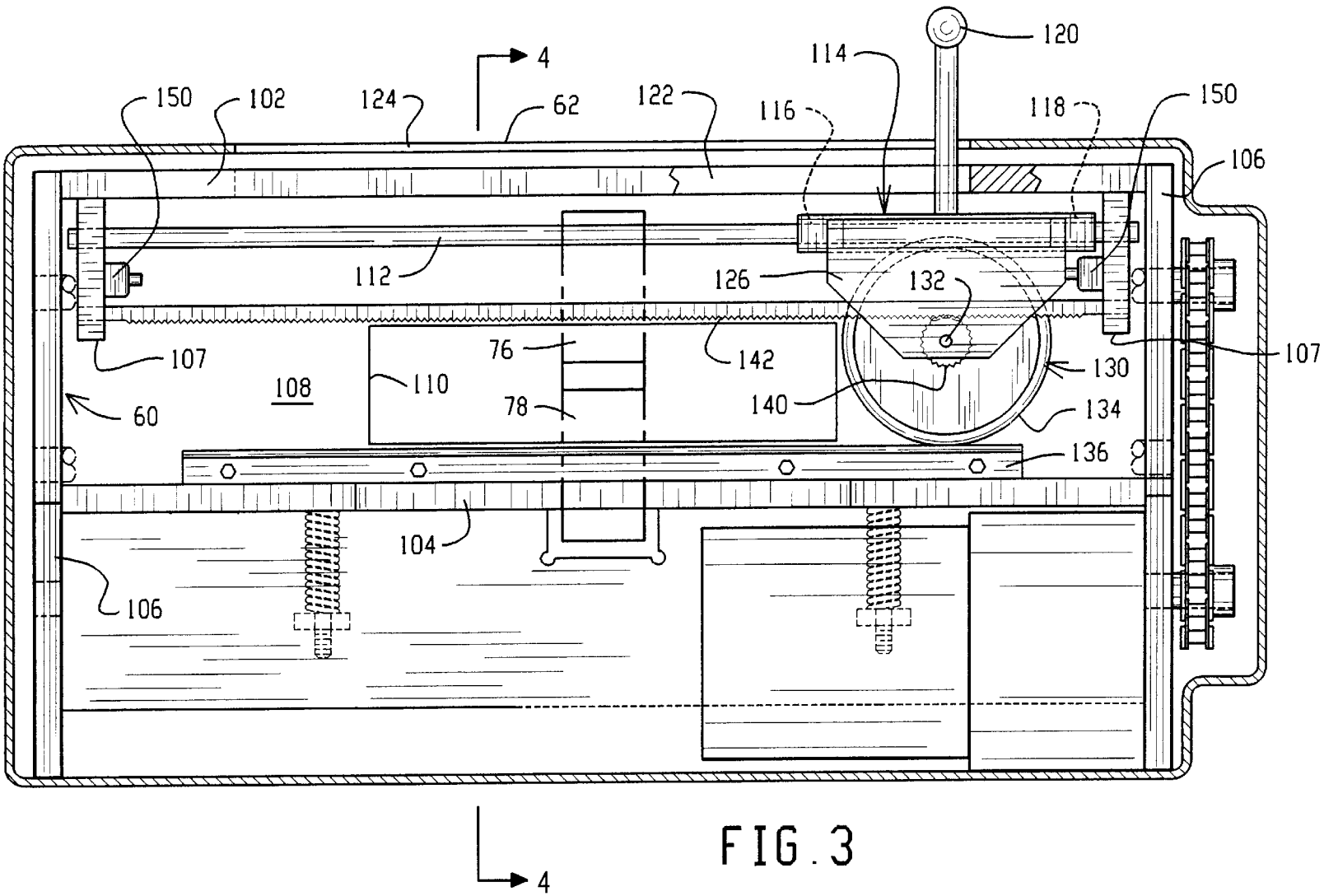
FIG. 3 is a cross-sectional view taken along the line 3—3 of FIG. 2.
Figure 4:
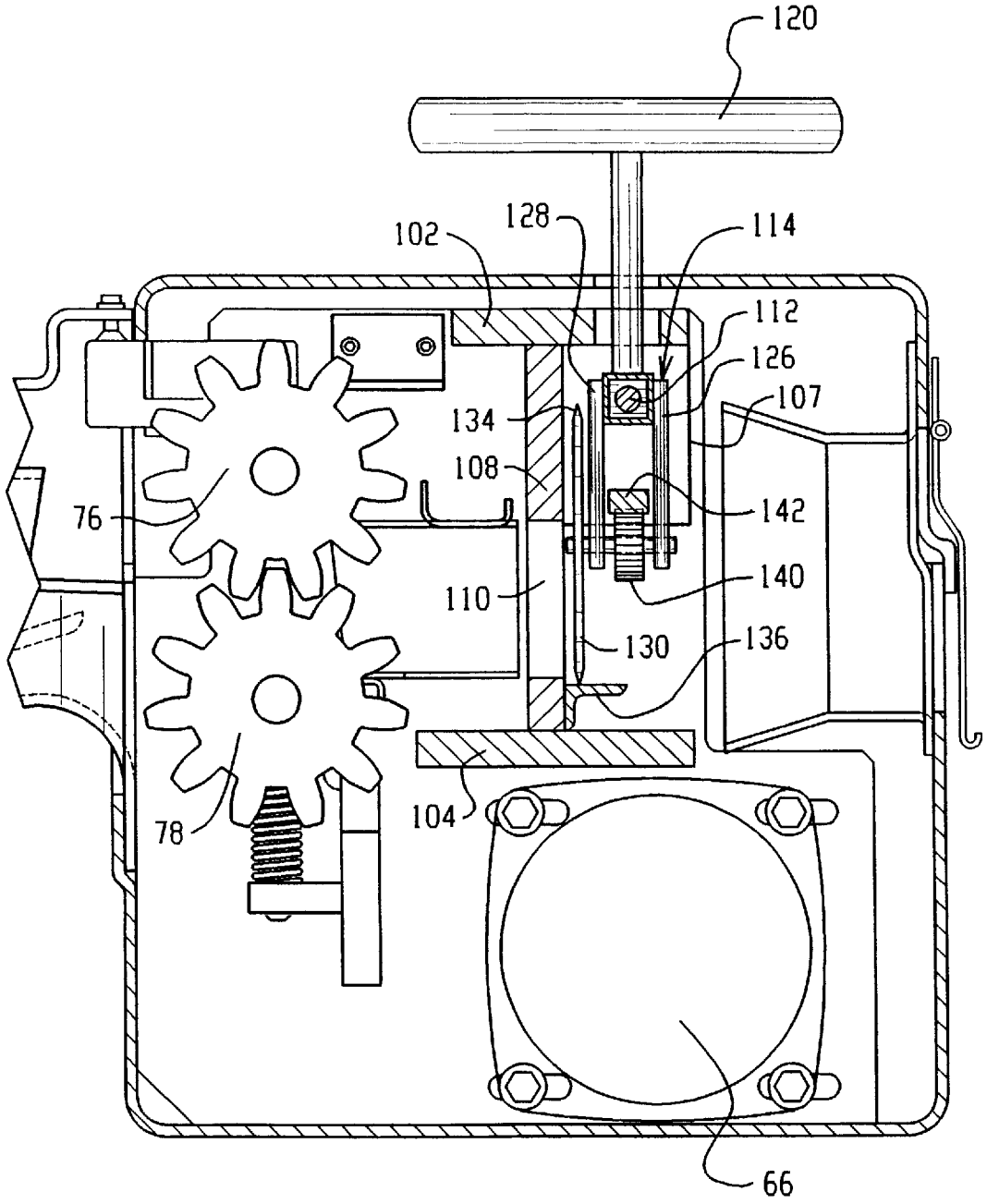
FIG. 4 is a cross-sectional view taken along the line 4—4 of FIG. 3.

The present invention provides additional severing mechanisms, including the severing mechanism 100 illustrated in FIGS. 2–4. The severing mechanism 100 includes upper and lower horizontal frame members 102 and 104, respectively, which extend laterally between the vertical side frame plates 106 of the frame 60. The frame members 102 and 104 (which also form a part of the frame 60) are parallel to each other and spaced above and below the path of the converted sheet material. A vertical frame element 108 extends between the upper and lower frame members 102 and 104 and between the two side plates 106, the vertical frame element being mutually perpendicular to all of these. The vertical frame element includes a rectangular opening 110 through which the converted sheet material passes.

The severing mechanism 100 includes a rod 112 which extends between the two side brackets 107 parallel to the vertical frame element 108 and just downstream of the opening 110. A carriage 114 is mounted on the rod and is slidable along the rod in a direction transverse to the path of the converted sheet material, the rod functioning as a guide track and support for the carriage. The carriage 114 includes bearings 116 and 118 which allow it to slide easily on the rod 112. The carriage also includes a handle 120 which is mounted on the top of the carriage 114. The handle 120 may have the illustrated T-shape, with the stem thereof extending through a slot 122 in the upper horizontal frame member 102 and a corresponding, aligned slot 124 in the outer casing 62.

Figure 4A:
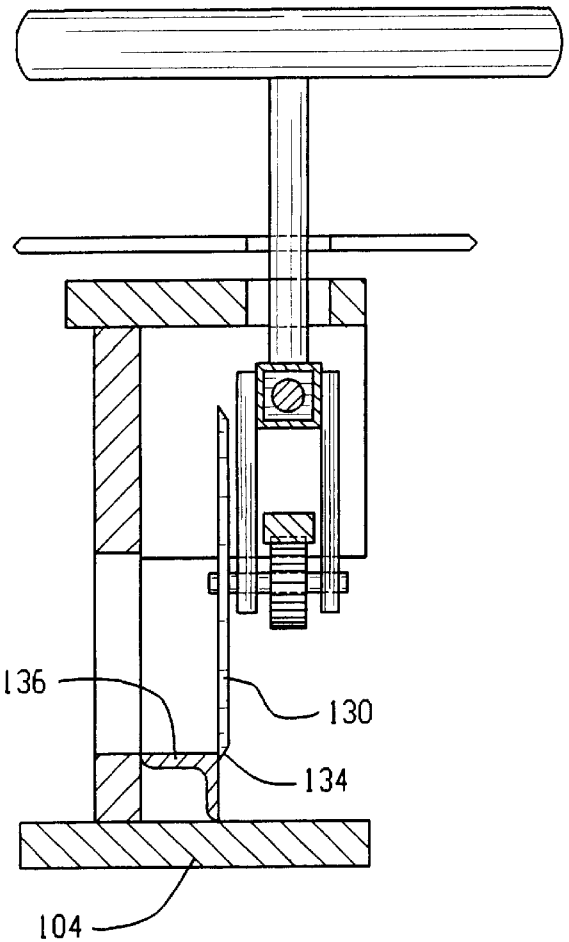
FIG. 4A is a simplified partial view of a portion of FIG. 4, showing an alternative mounting of the severing member 130;.

The carriage 114 also includes a pair of downwardly extending side plates 126 and 128. These side plates provide a mounting point for the circular severing member 130. The circular severing member 130, for example a cutting wheel, is rotatably mounted on a shaft 132 that extends between the side plates 126 and 128. The severing member 130 has a sharp, peripheral edge 134 that bears against a planar support surface on a fixed angle 136 which is mounted to the vertical frame element 108. The fixed angle 136 is parallel to the rod 112, and so the edge 134 is in contact with the fixed angle, regardless of where along the rod the carriage 114 happens to be. (See FIG. 4). Alternatively, the fixed angle 136 may be mounted so that the edge 134 contacts the vertical surface of the angle 136 regardless of where along the rod the carriage 114 happens to be. (See FIG. 4A.)

The severing member 130 is driven to rotate about the shaft 132 by means of a spur gear 140 which cooperates with a rack 142. The gear 140 is fixed to the shaft 132 as is the severing member 130. The rack 142 is parallel to the rod 112 and extends between and is mounted to the side brackets 107. When the handle 120 is used to move carriage 114 across the rod, the gear and rack 140 and 142 drive the severing member 130 so that its edge 134 has a greater velocity than the carriage 114 with respect to the fixed angle 136. This action severs the converted sheet material into a strip of the desired length. Limit switches 150 may be provided to activate the feed motor 66.

Figure 5A:
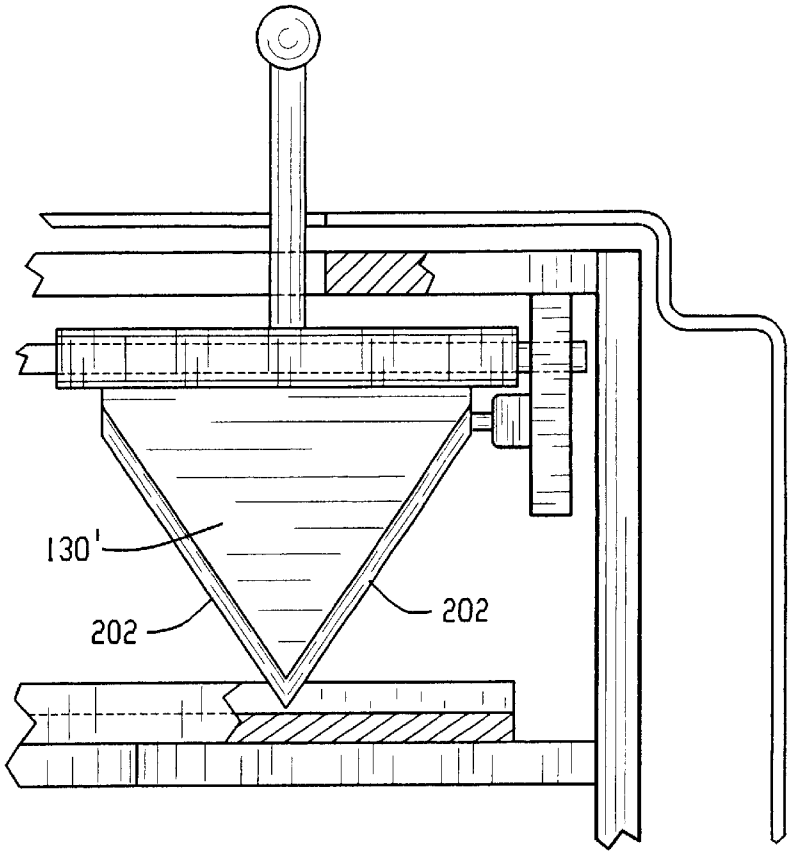
FIG. 5A is an end view of an alternative severing member for the second embodiment of the present invention.
Figure 5:
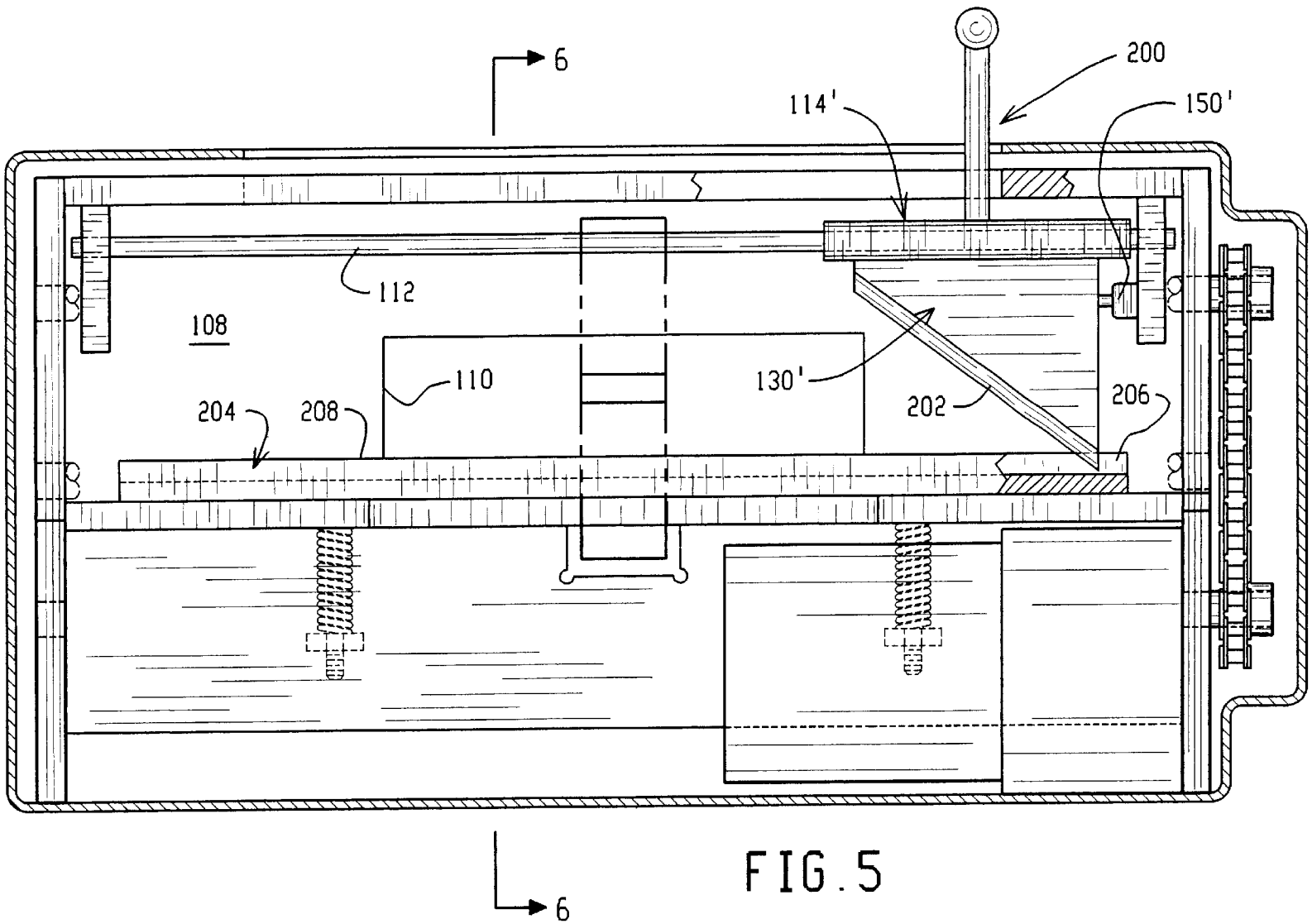
FIG. 5 is an end view transverse to the strip path through the machine showing a second embodiment of the present invention.
Figure 6:
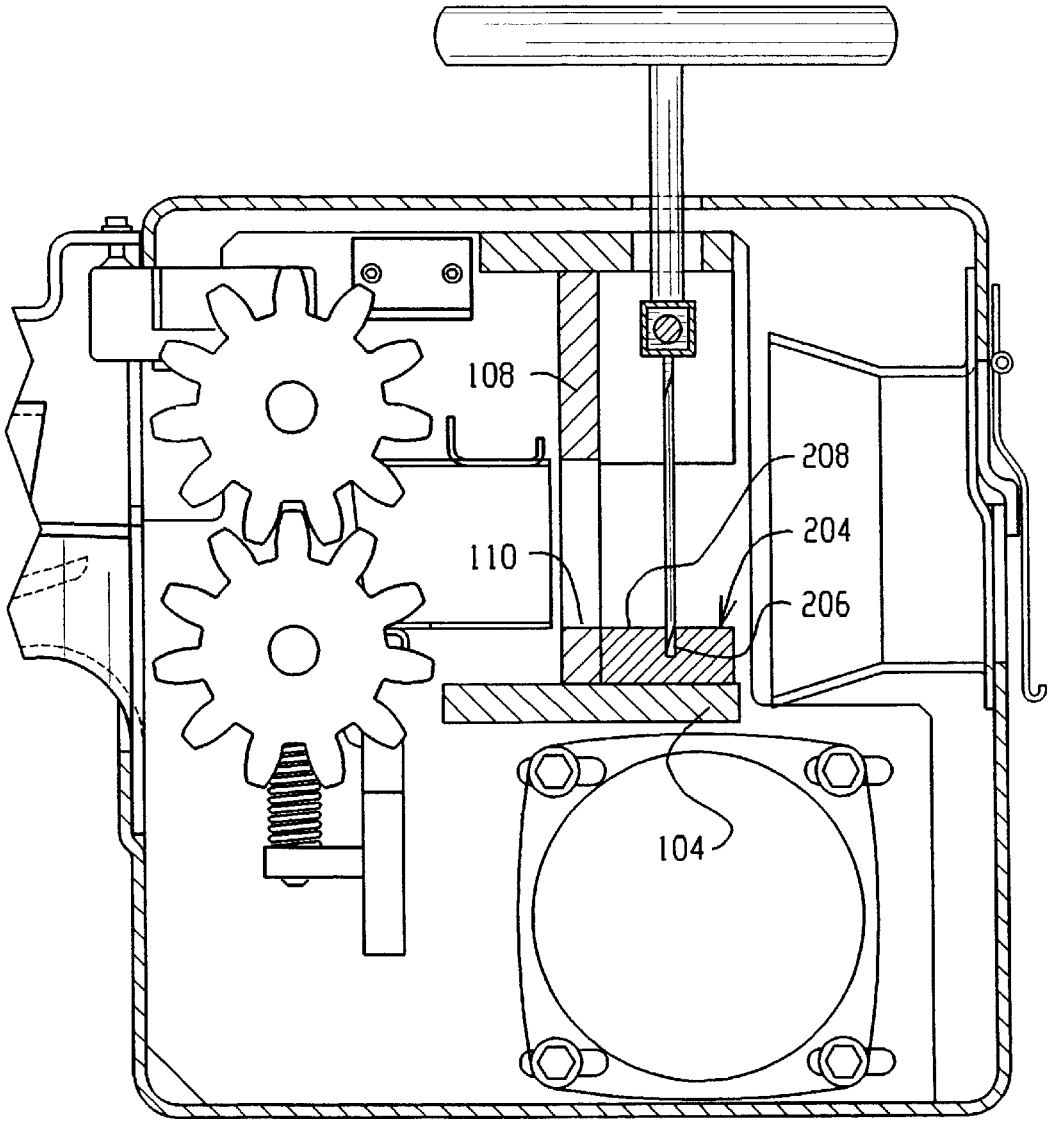
FIG. 6 is a cross-sectional view taken along the line 6—6 of FIG. 5.
Figure 7:
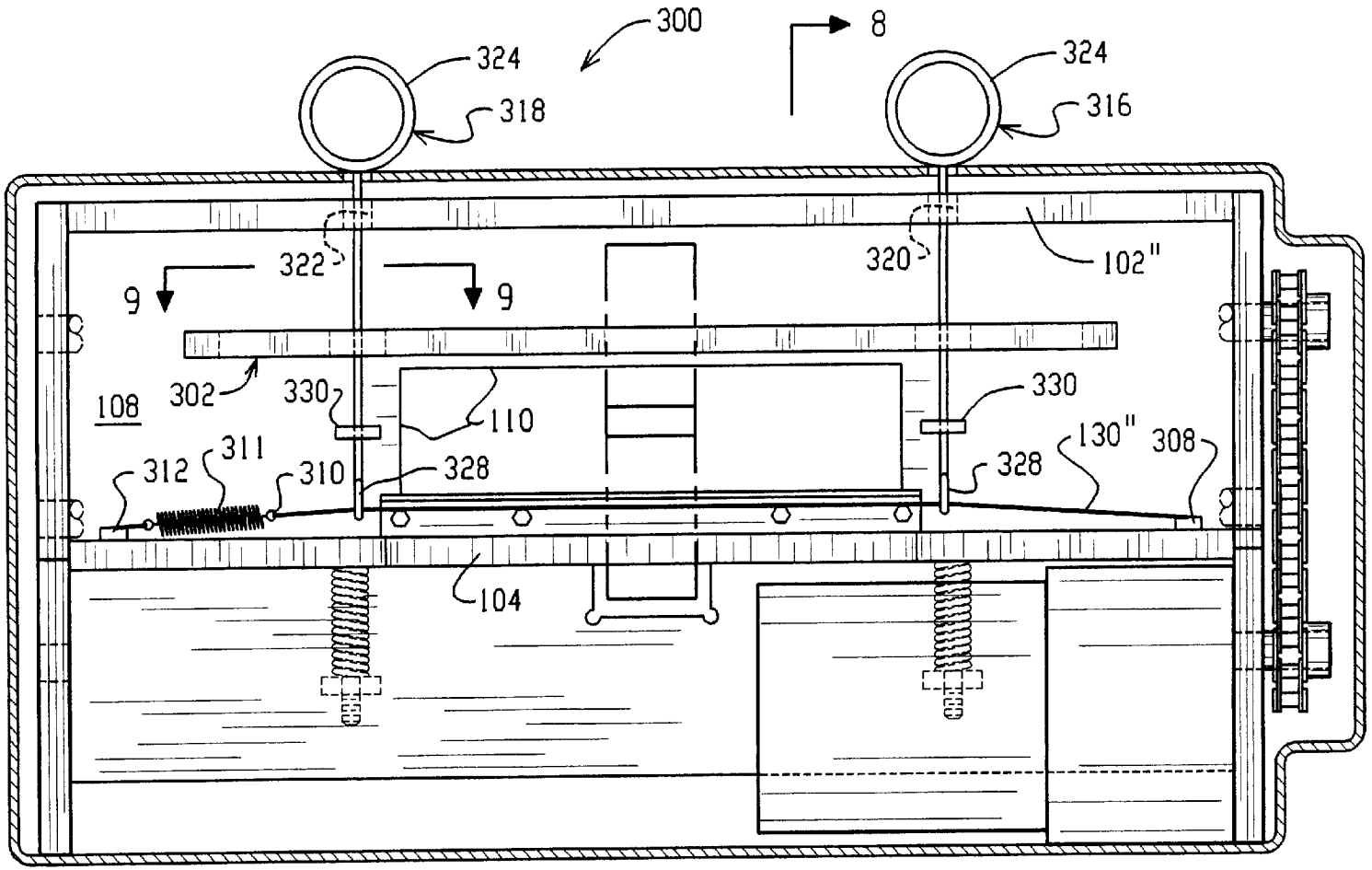
FIG. 7 is an end view transverse to the strip path through the machine and showing a third embodiment of the present invention.
Figure 8:
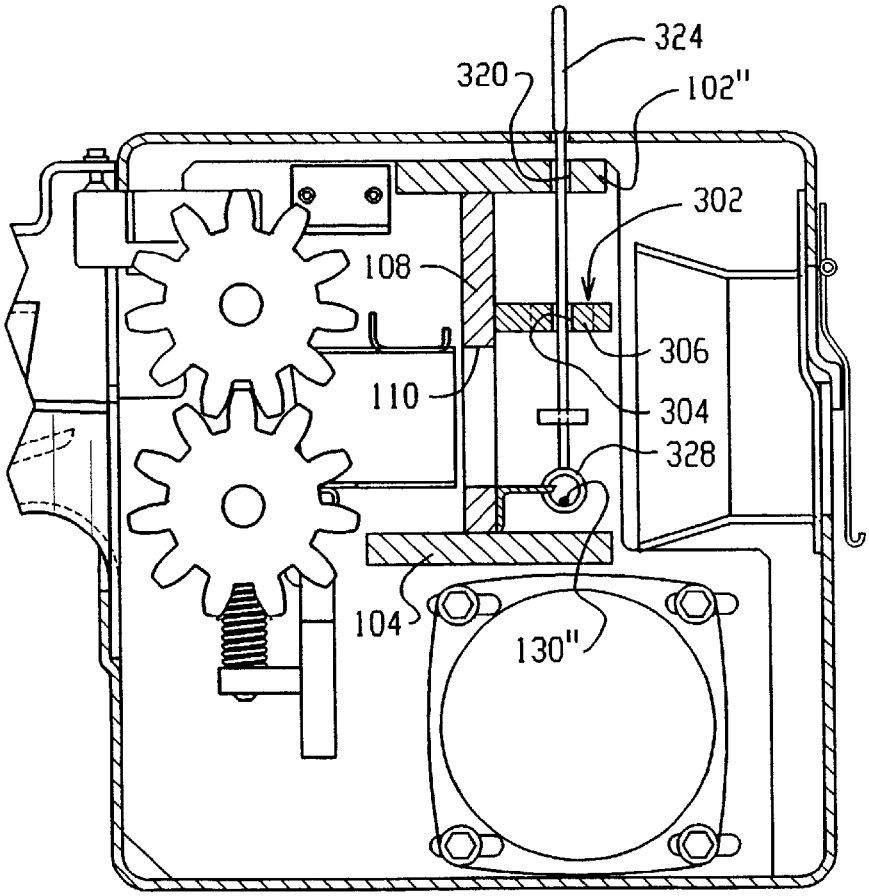
FIG. 8 is a cross-sectional view taken along the line 8—8 of FIG. 7.
Figure 9:
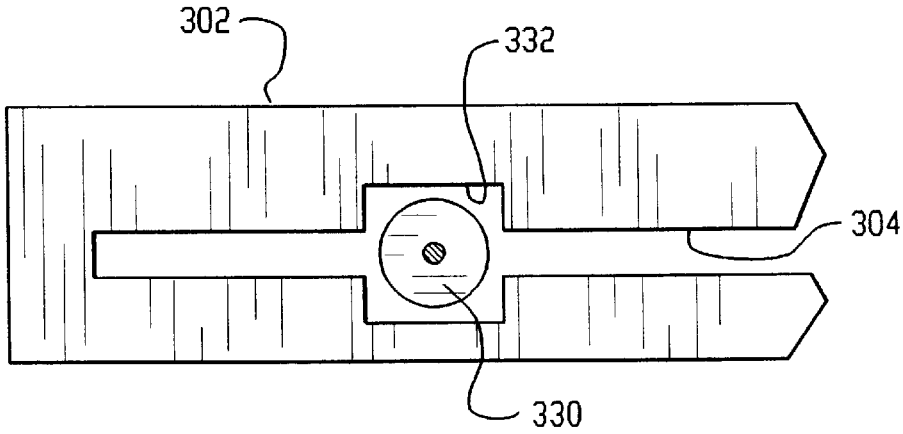
FIG. 9 is a view looking in the direction of arrows 9—9 of FIG. 7.

The present invention further provides the severing mechanism 200 illustrated in FIGS. 5 and 6. Where structural elements are identical to the elements in earlier described embodiments, identical reference numerals have been used. Where structural elements are similar to corresponding elements in previously described embodiments, the same reference numerals are used with a prime (') added. This same convention is used throughout this application.

The severing mechanism 200 includes a severing member 130' mounted to the carriage 114'. The severing member 130' is in the form of a thin blade mounted for lateral movement in a plane perpendicular to the path of the converted strip of cushioning. The severing member 130' is formed with a sharp severing or knife edge 202 which is inclined relative to the movement direction of the severing member. As illustrated, the edge 202 is at about a 45 degree angle to the guide rod 112. (See FIG. 5.) Alternatively, the severing member 130' may be formed with two knife edges inclined in opposite directions. (See FIG. 5A.)

The severing mechanism 200 also includes a blade guide or track 204. The blade guide 204 is mounted to the lower horizontal frame member 104, and it has a guide slot 206 which extends parallel to and directly below the rod 112. The slot 206 receives the lowermost tip of the severing member 130' and maintains the severing member in alignment with the rod 112.

The blade guide 204 has a top surface 208 which is flush with the bottom of the opening 110 through the vertical frame element 108. When the handle 120 is used to push the carriage 114' across the rod 12, the inclined edge 202 of the severing member 130' squeezes the converted sheet material against the top surface 208 which forms a reaction surface for the severing member 130'. The converted sheet material is severed through by the combined effect of the inclined sharp edge 202 and the reaction surface 208 of the guide track 204. If the severing member of FIG. 5A is used, it will cut in both directions thereby making alternative cuts in both directions. One or more limit switches 150' may be provided to activate the feed motor 66.

The present invention further provides the severing mechanism 300 illustrated in FIGS. 7–11. The severing mechanism 300 includes a support member 302 which is connected to the vertical frame element 108. The support member 302 has a slot 304 which extends transverse to and above the path of the converted sheet material through the opening 110. As will be seen from the following description, the support member also includes a lower, horizontal surface 306 to which the slot 304 opens and which forms a reaction surface for the severing operation.

The severing member 130" takes the form of a thin wire such as piano wire. Alternatively or additionally, the wire 130" may be coated with an abrasive. In either event, the wire 130" is secured at one end 308 to the lower horizontal frame member 104 by any suitable means. The opposite end 310 of the wire 130" is connected to a stiff coil spring 311 which is in turn mounted at 312 to the horizontal frame member 104. The mounting points 308 and 312 are on opposite sides of the opening 110 through the vertical frame element. As a result the wire 130" in its initial position is stretched taught below the path of the converted sheet material.

The severing mechanism 300 further includes a pair of hooks 316 and 318 which serve to lift the wire 130" to effect the severing operation. The hooks 316 and 318 are vertically moveable through holes 320 and 322, respectively, through the upper horizontal frame member 102". Each of the hooks 316 and 318 has a large loop 324 at its top to permit the hook to be gripped and lifted. The hooks 316 and 318 also each have a loop 328 at their lower ends through which the wire 130" passes. In addition each of the hooks 316 and 318 includes a collar 330 to limit upward travel of the hooks. To accommodate the collars 330, the slot 304 includes enlarged areas 332 (FIG. 9) through which the collars can pass.

Figure 10:
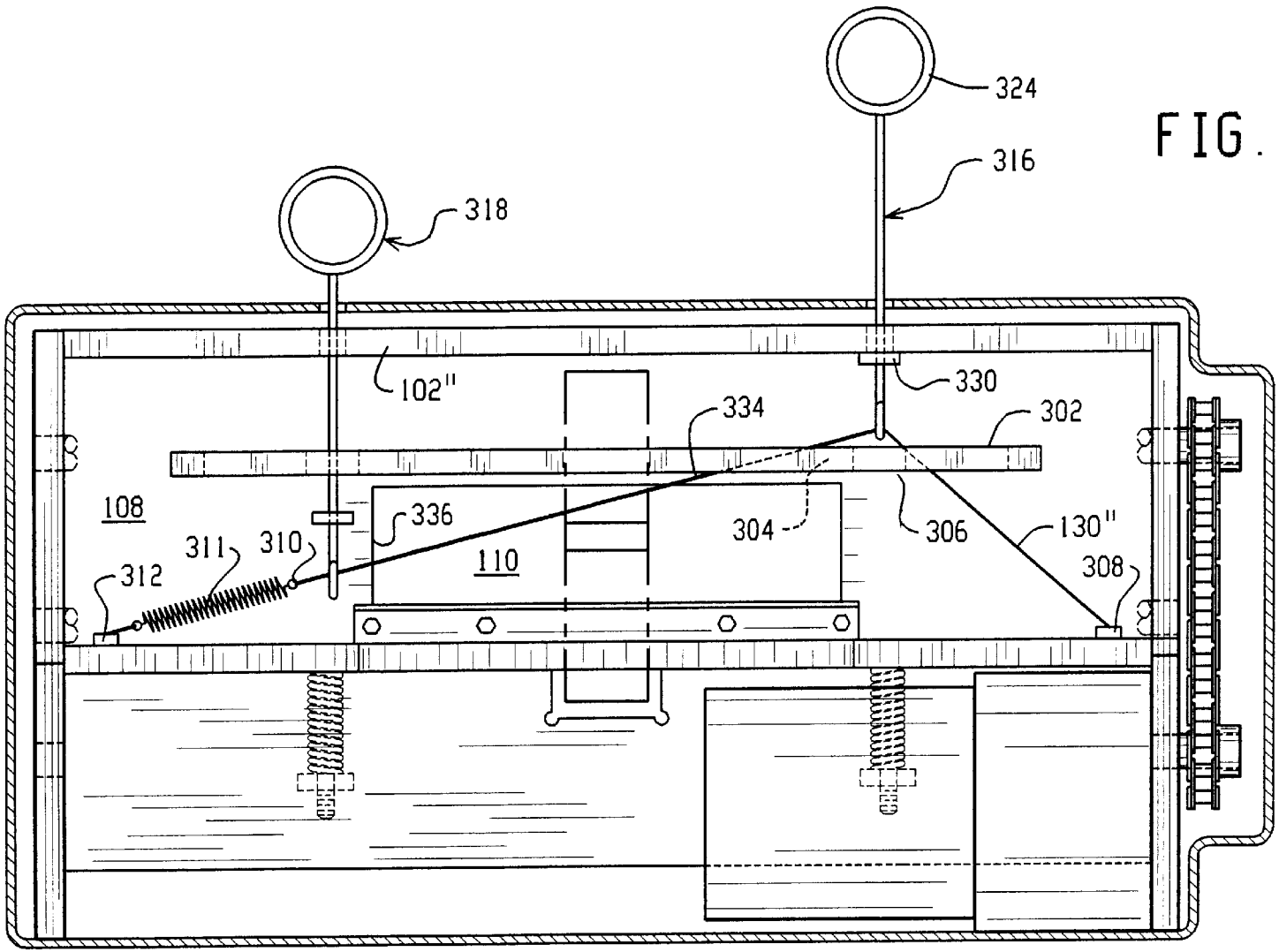
FIG. 10 is a view generally similar to FIG. 7, but showing a severing member partway through a severing process.
Figure 11:
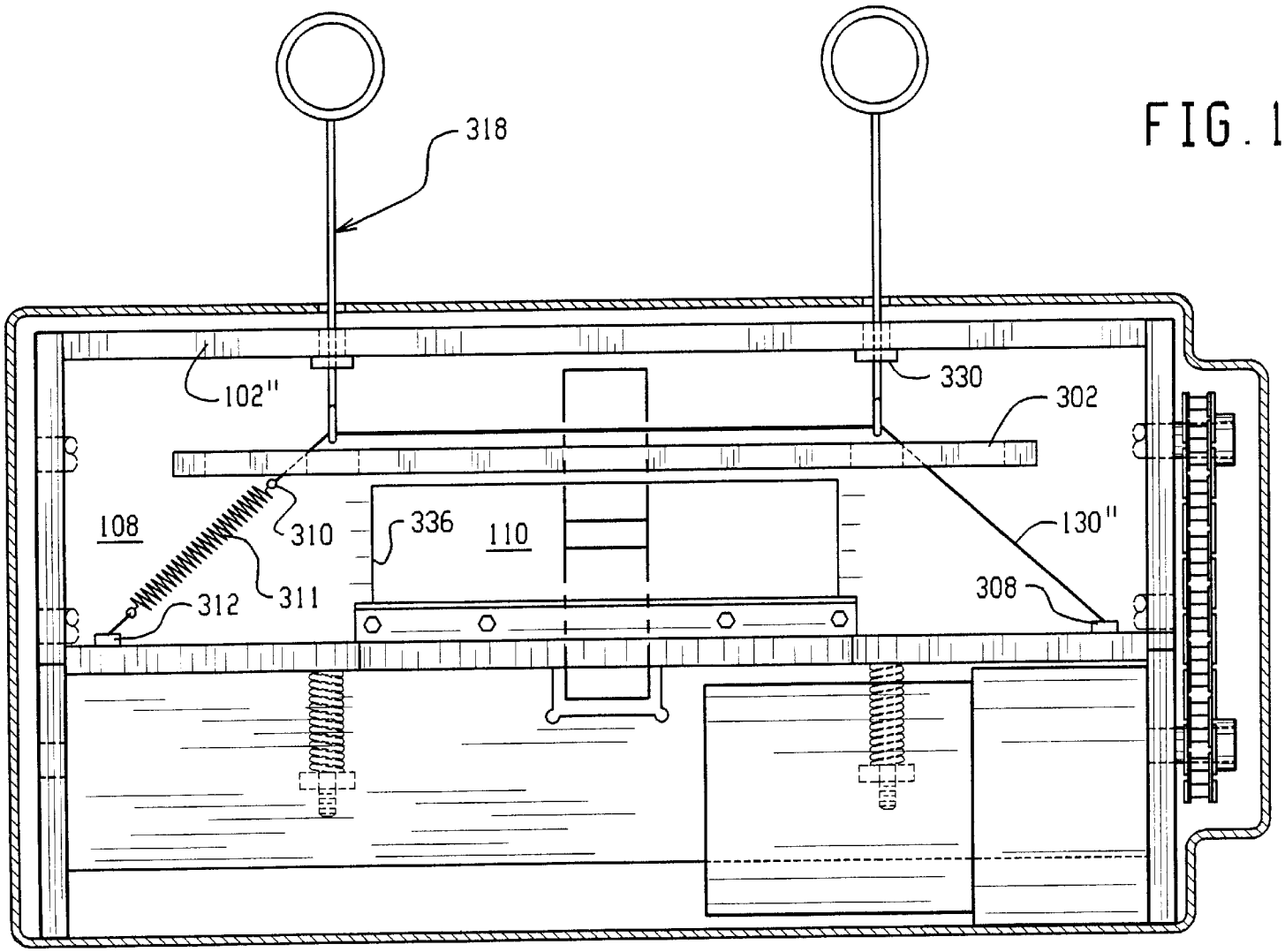
FIG. 11 is a view similar to FIG. 10 but showing the severing member after completing the severing process.

To sever a desired length of converted sheet material, the hooks 316 and 318 are sequentially or simultaneously lifted to pull the wire 130" through the sheet material. For example, the hook 316 can be lifted first as shown in FIG. 10. The spring 311 stretches some as the wire 130" moves upward. The collar 330 is positioned so that the wire 130" passes through the slot 304 in the support member 302 before the collar hits the underside of the upper frame member 102". As this occurs a nip 334 is formed between the bottom 306 of the support member 302 which squeezes the converted sheet material and severs it. Next the other hook 318 is lifted upward. As shown in FIG. 11, this finishes the squeezing and severing operation as the converted sheet material is forced upward against the support member 302 and the vertical side 336 of the opening 110 through the vertical frame element 108. Alternatively, the wire 130" may be initially tensioned and then released to sever the desired length of converted sheet material.

Figure 12:
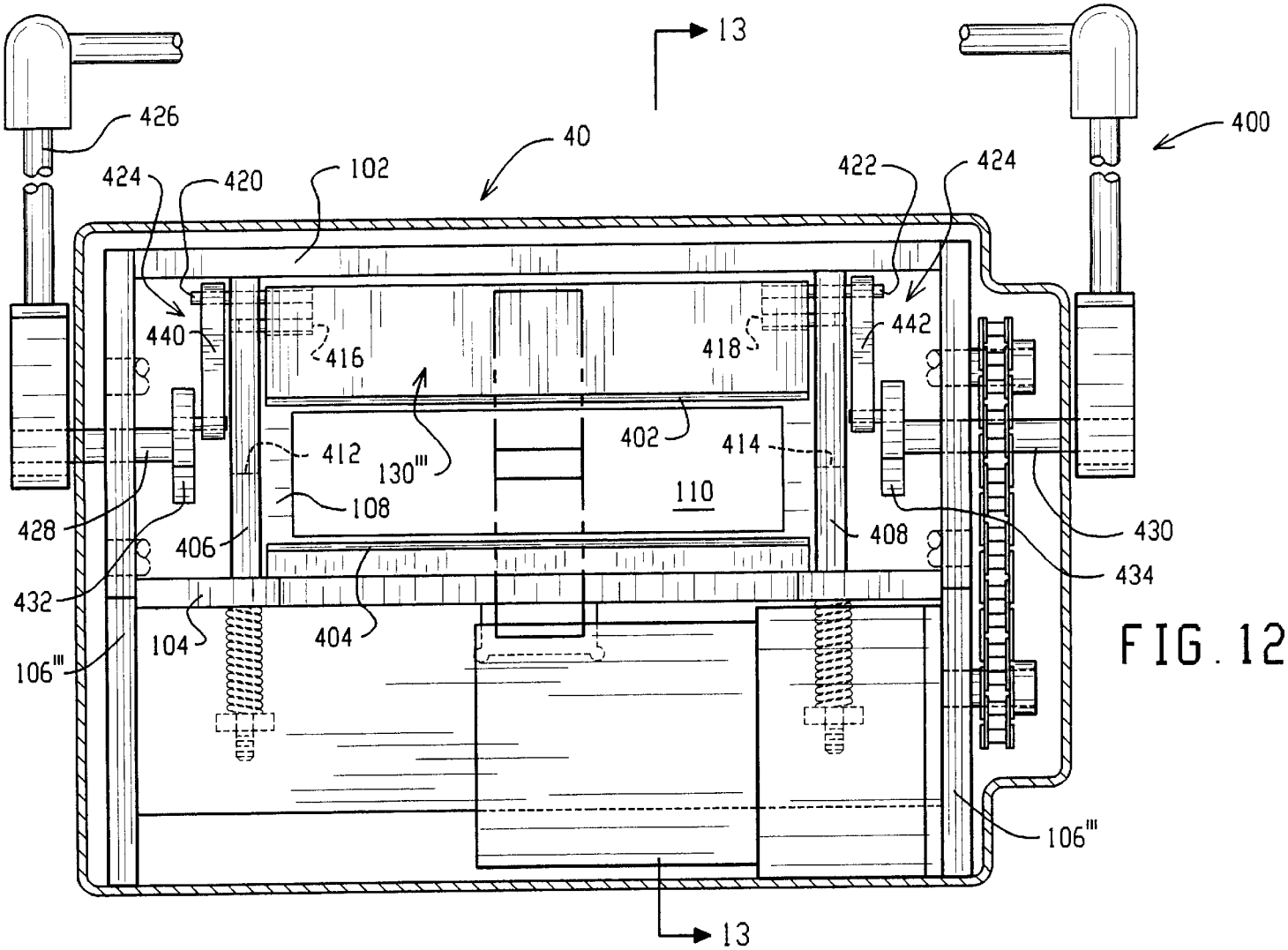
FIG. 12 is a cross-sectional view looking in a direction transverse to the path of the strip through the machine and showing a fourth embodiment of the present invention.
Figure 13:
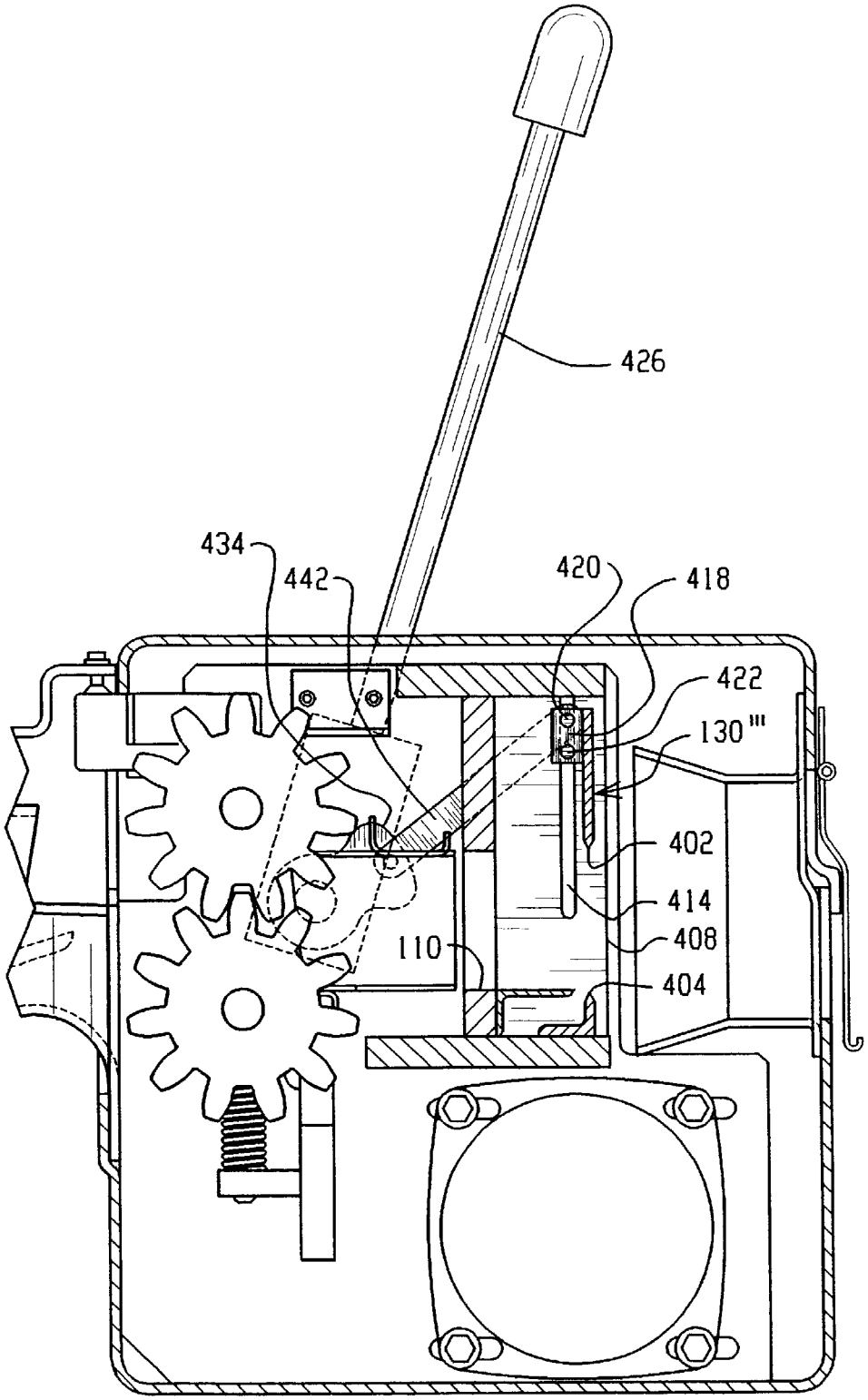
FIG. 13 is a cross-sectional view taken along the line 13—13 of FIG. 12.
Figure 14:
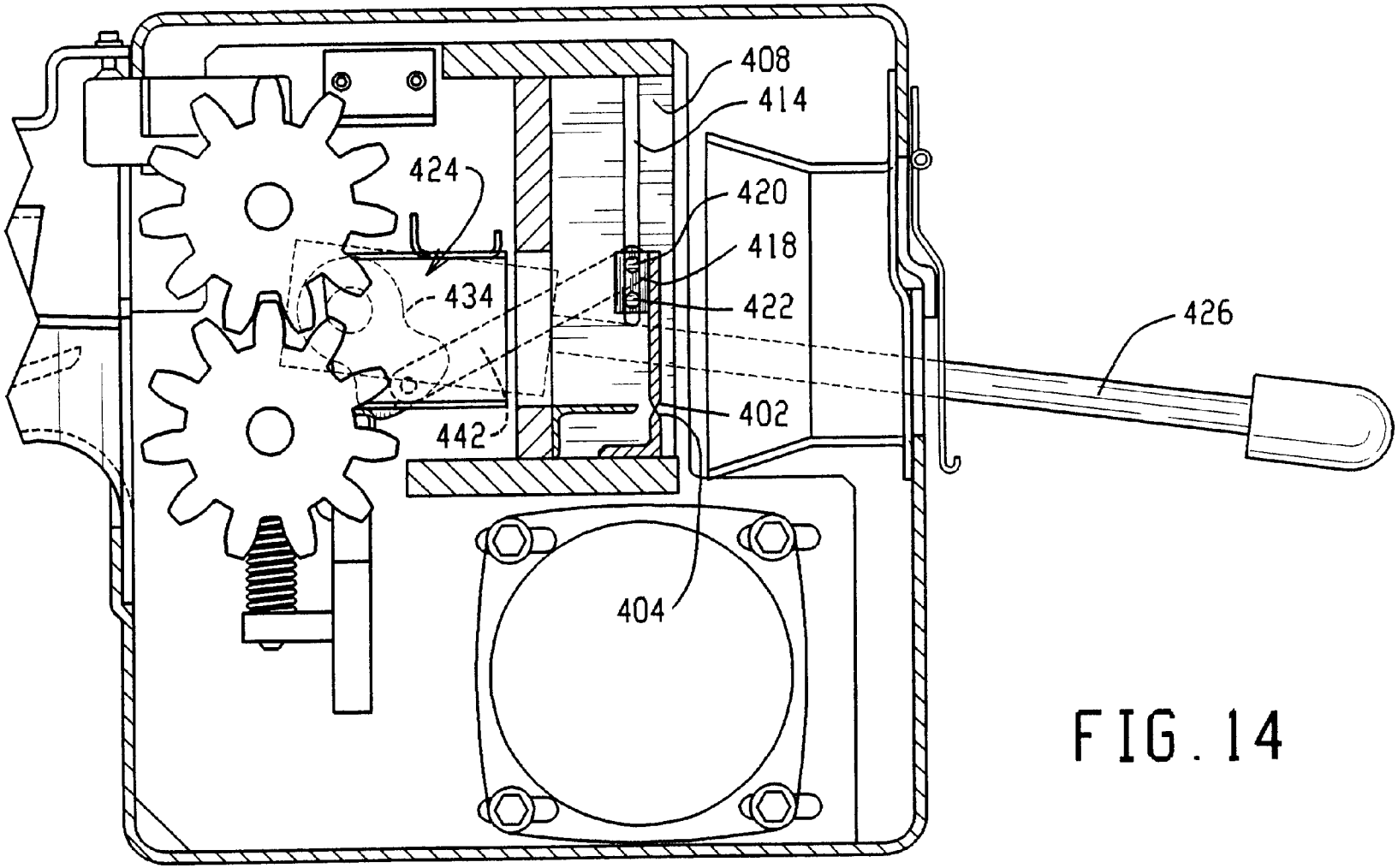
FIG. 14 is a view similar to FIG. 13 but showing the severing member at the completion of its severing stroke.

The present invention further provides the severing mechanism 400 illustrated in FIGS. 12–14. The severing mechanism 400 includes a vertically movable severing element 130'" in the form of a knife blade which has a sharp lower edge 402. The lower edge 402 is initially positioned above the path of the converted sheet material and can be moved downward to engage a fixed opposing knife edge 404 to effect the severing operation.

The severing mechanism 400 further includes a pair of side plates 406 and 408 which are generally vertical and extend between the upper and lower horizontal frame members 102 and 104 and which have an upstream edge abutting the vertical frame element 108'. The side plates 406 and 408 are positioned on opposite sides of the opening 110 through the vertical frame element 108'. Each of the side plates 406 and 408 includes a guide slot 412 and 414, respectively (FIGS. 12 and 13), which guide the movement of the severing member or blade 130'".

The blade 130'" is generally rectangular, and its lower edge 402 is generally straight and horizontal. The blade 130'" is supported by a pair of mounting blocks 416 and 418 which are mounted to the upper corners of the blade. Each of the mounting blocks has a pair of vertically aligned pins 420 and 422 which extend laterally from the block and are received in the respective slots 412 and 414. The pins assure that the blade 130'" moves in the straight line defined by the slots 412 and 414. The lower pins 422 extend only far enough to reach into but not completely through the slots 412 and 414. The upper pins, 420, on the other hand, extend all the way through the respective slots 412 and 414 and laterally outwardly beyond the side plates 406 and 408 to provide a mounting point for a linkage 424 which drives the blade 130'" up and down.

The linkage 424 includes a U-shaped handle 426 which spans the width of the head unit 40 in the same manner as the handle 82 shown in FIG. 1. The handle 426 (FIGS. 12–14) is rotatably mounted by stub shafts 428 and 430 which are rotatably mounted in the side frames 106'". The outer ends of the shafts 428 and 430 are connected to the handle 426, while the inner end of each shaft is connected to a crank arm 432 and 434, respectively. The crank arms 432 and 434 each have a pinned connection to one end of a respective connecting rod 440 and 442, respectively. The opposite ends of the connecting rods 440 and 442 are pivotally connected to the pins 420 which drive the blade 130'".

The blade 130'" is initially in the position shown in FIGS. 12 and 13, and the converted sheet material is free to pass through the opening 110 with the lower edge 402 of the blade 130'" above the path of the sheet material and the fixed knife edge 404 below. Once the desired length of cushioning has been produced, the feed motor is deactivated (either manually or automatically) and the handle 426 is pulled down (clockwise as viewed in FIGS. 13 and 14). This brings the edges 402 and 404 into contact through the operation of the linkage 424, and so severs the material.

The present invention further provides the severing mechanism 500 illustrated in FIGS. 15–19. The severing mechanism includes a pair of oscillating serrated blades 502 and 504 (FIGS. 15 and 18) which form the severing member. The blades 502 and 504 move downward across the opening 110 (FIG. 15) through which the converted sheet material passes, and the oscillating motion of the blades severs the material as desired by the operator.

The mechanism 500 further includes two sets of vertical guide assemblies 506 and 508 which extend between the upper and lower horizontal frame members 102 and 104. Each set of vertical guide assemblies is formed from two flat plates 510 and 512 shown in FIG. 18. The two plates 510 and 512 are set with their major side surfaces facing each other and spaced apart by the combined thickness of the blades 502 and 504. The plates 510 and 512 assure that the blades 502 and 504 can move vertically, but cannot twist, so that the serrated bottom edges of the blades are always facing down.

Figure 16:
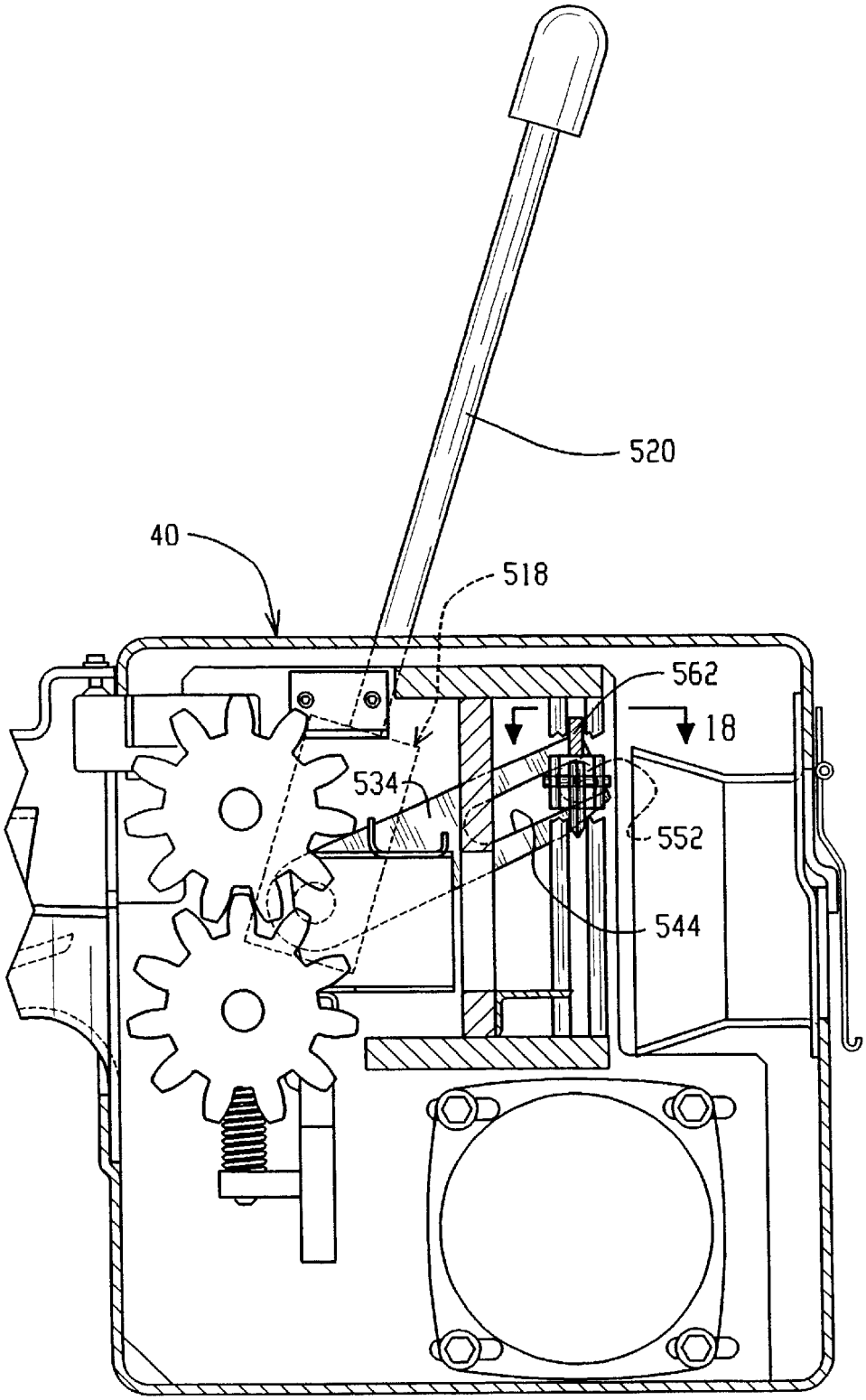
FIG. 16 is a cross-sectional view taken along the line 16—16 of FIG. 15.
Figure 17:
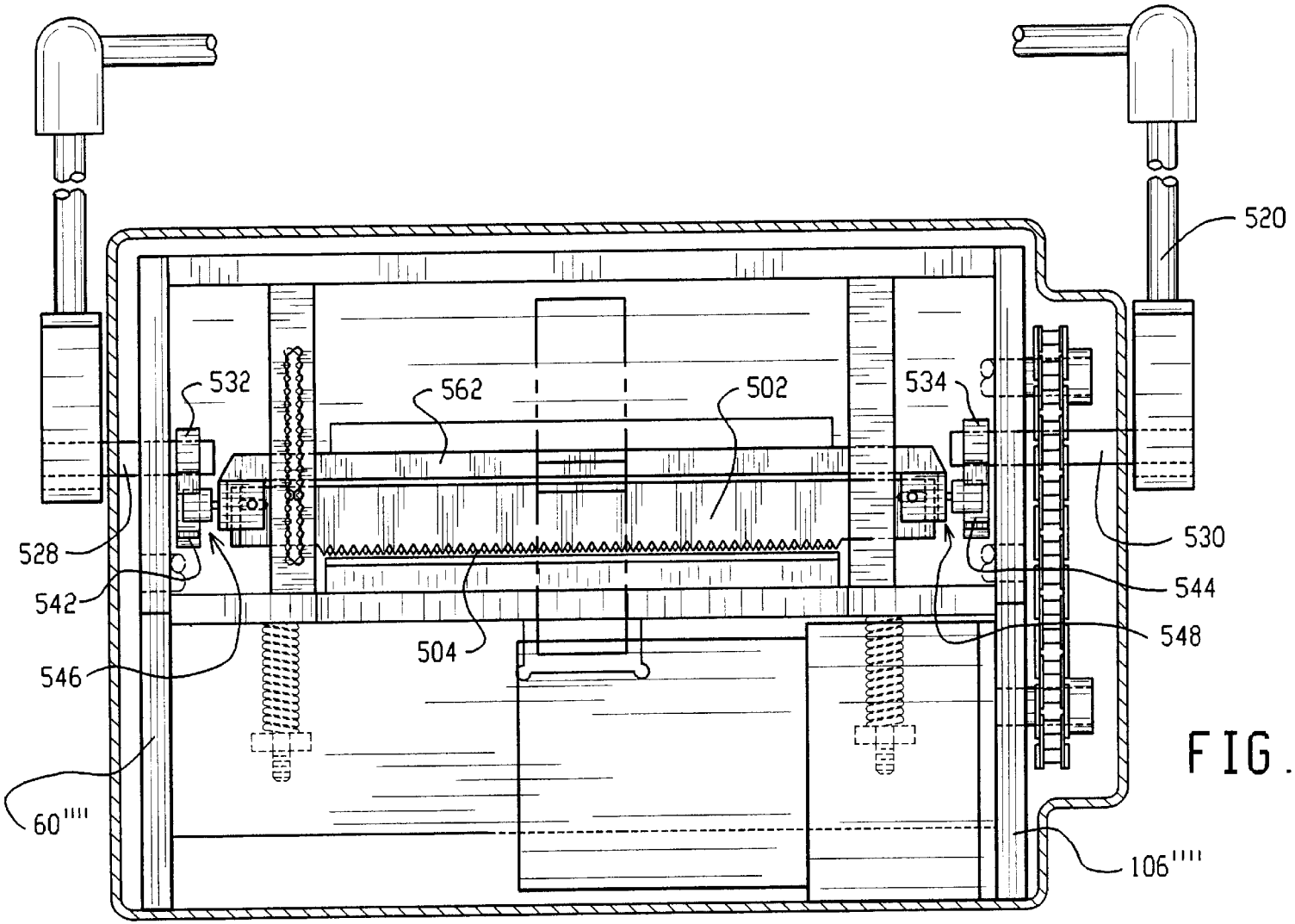
FIG. 17 is a view generally similar to FIG. 15 but showing the severing members at the completion of their severing stroke.
Figure 18:
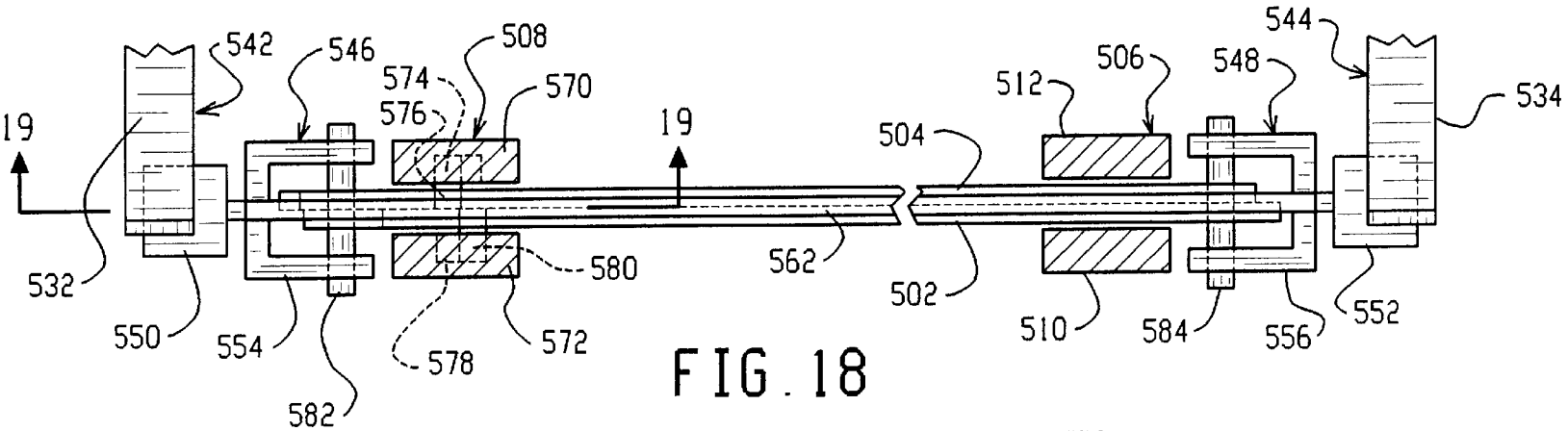
FIG. 18 is a cross-sectional view taken along the line 18—18 of FIG. 16.

The blades 502 and 504 are driven vertically by a linkage mechanism 518 (FIG. 16). The linkage 518 includes a U-shaped handle 520 which spans the width of the head unit 40 in the same manner as the handle 82 shown in FIG. 1. The handle 520 is rotatably mounted by stub shafts 528 and 530 which are rotatably mounted in the side frames 60"" and 106"". The outer ends of the shafts 528 and 530 are connected to the handle 520, while the inner end of each shaft is connected to a crank arm 532 and 534, respectively. The crank arms 532 and 534 each have a slot 542 and 544, respectively, which engages and drives a follower assembly 546 and 548, respectively, one of which is connected to each lateral end of the blades 502 and 504.

The follower assemblies 546 and 548 (FIG. 18) each include a follower 550 and 552 which fit in the slot 542 and 544 of each crank arm 532 and 534, respectively. A U-shaped bracket 554 and 556 is connected to the respective follower and it straddles the two blades 502 and 504. Each of the blades 502 and 504 includes a horizontally extending slot 560 (FIG. 19) so that the blades can oscillate laterally with respect to the follower assemblies. The two follower assemblies may also be connected to each other by a stiffening rib 562 (FIGS. 15, 17 and 19), which assures that the axes of the followers 550 and 552 are the same. The stiffening rib 562 is narrower than the combined thickness of the blades 502 and 504 and centered above them.

Figure 15:
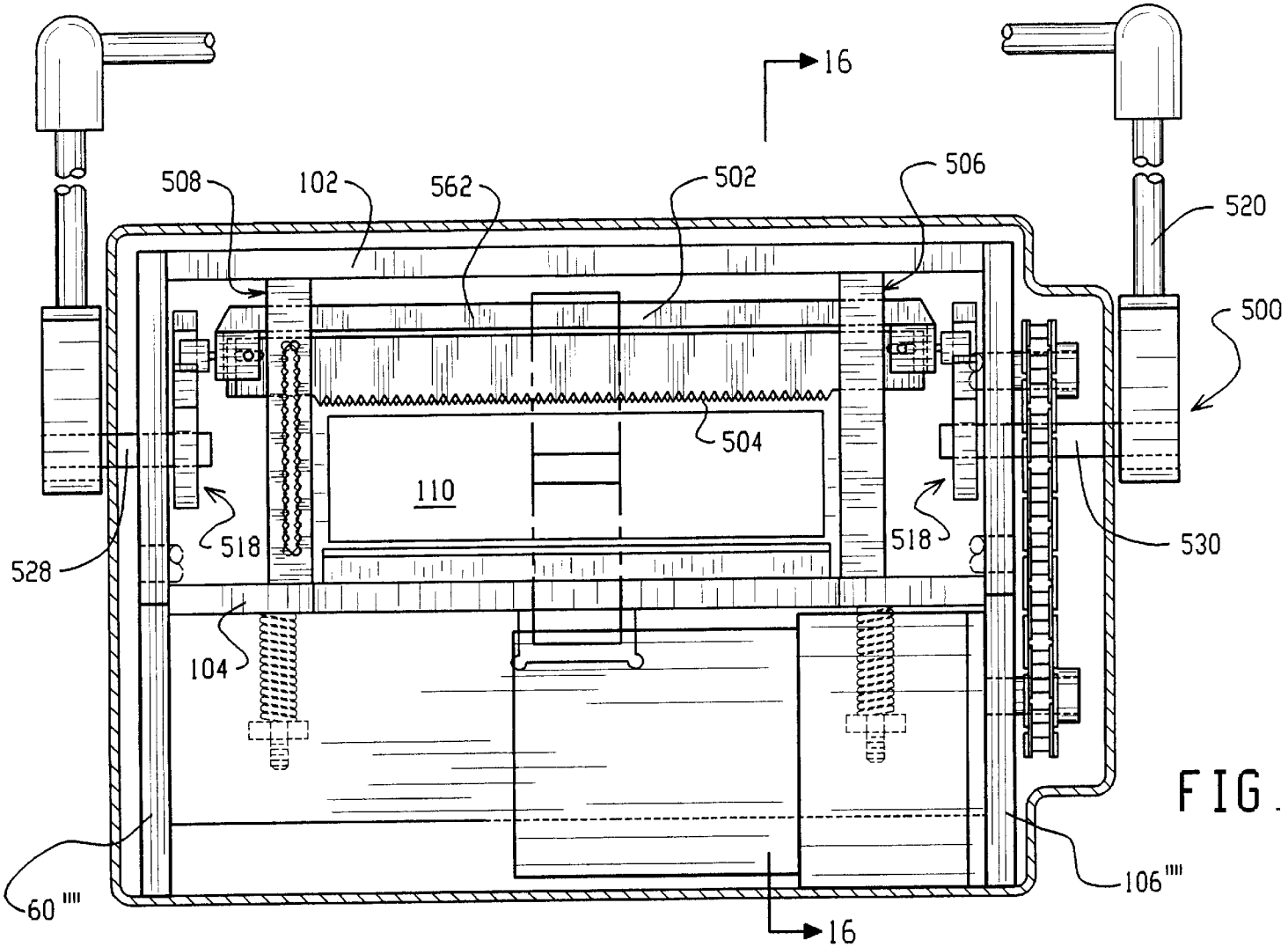
FIG. 15 is a cross-sectional view transverse to the strip path through the machine and showing a fifth embodiment of the present invention.

The blades 502 and 504 are initially in the position shown in FIGS. 15 and 16, and the converted sheet material is free to pass through the opening 110 with the serrated lower edges of the blades above the path of the sheet material. Once the desired length of material has been converted, the handle 520 is pulled down (clockwise as viewed in FIG. 16). This brings the blades 502 and 504 downward through the operation of the linkage 518.

Figure 19:
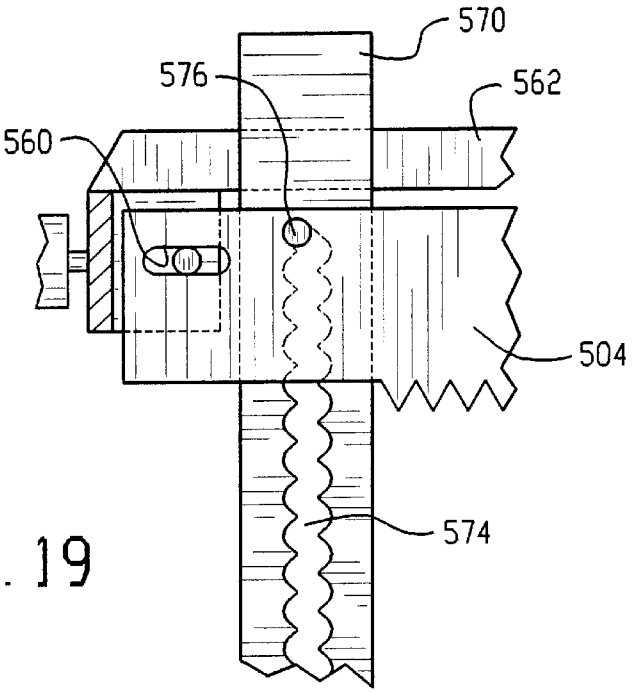
FIG. 19 is a view looking in the direction of arrows 19—19 of FIG. 18.

The guide bars 570 and 572 of the set 508 each have a zigzag slot 574 (FIG. 19). The slot 574 receives a cam follower in the form of a pin 576 which is secured to the blade 504. The slot 574 extends from above the top of the opening 110 to about even with the bottom of it. The slot 578 in the guide bar 572 is like the slot 574 but 180 degrees out of phase; the slot 578 zigs where the slot 574 zags and vice versa. The blade 502 also carries a follower pin 580 which fits in the slot 578.

Each of the follower assemblies 546 and 548 includes a pin 582 and 584, respectively, which passes through the slots 560 in the ends of the blades 502 and 504. When the follower assemblies 546 and 548 push down on the blades 502 and 504, the blades move downward, and the follower pins 576 and 589 track along in the respective slots 574 and 578, causing the blades 502 and 504 to oscillate laterally as they descend through the converted sheet material to sever the material at the desired location.

What is claimed is:

1. A cushioning conversion machine for converting sheet-like stock material into a relatively low density cushioning dunnage product, said machine comprising at least one conversion assembly for moving the stock along a pathway and forming the stock material into a three-dimensional strip of cushioning having pillow-like portions, and a severing mechanism for severing the strip of cushioning into sections of cushioning dunnage product, the severing mechanism comprising a track extending in a plane transverse to the pathway, a carriage mounted on the track for movement therealong, and a severing member mounted to the carriage for movement across the track and the pathway of the sheet material to sever the strip of cushioning into sections.

2. The machine of claim 1 wherein the severing mechanism includes a reaction member generally parallel to the track and on the opposite side of the pathway from the track.

3. The machine of claim 2 wherein the carriage includes a manually engageable handle to move the carriage across the track.

4. The machine of claim 2 wherein the severing member is a circular blade and having a sharp, circular peripheral edge bearing against the reaction member, and a pair of gears driving the blade in rotary motion such that when the carriage is moved along the rail, the velocity of a point on the periphery of the blade is relatively greater than the velocity of the carriage relative to the reaction member.

5. The machine of claim 4 wherein the pair of gears includes a rack extending parallel to the rail and a gear meshing with the rack.

6. The machine of claim 5 wherein the carriage includes a handle extending from the carriage.

7. A cushioning conversion machine for converting sheet-like stock material into a relatively low density cushioning dunnage product, said machine comprising at least one conversion assembly for moving the stock along a pathway and forming the stock material into a three-dimensional strip of cushioning, and a severing mechanism for severing the strip of cushioning into sections of cushioning dunnage product, the severing mechanism comprising a track extending in a plane transverse to the pathway, a carriage mounted on the track for movement therealong, and a severing member mounted to the carriage for movement across the track and the pathway of the sheet material to sever the strip of cushioning into sections;

wherein the severing mechanism includes a reaction member generally parallel to the track and on the opposite side of the pathway from the track; and wherein the severing mechanism comprises a guide member parallel to the rail and below the pathway, the guide member having a longitudinal slot, and wherein the severing member comprises a blade extending downward from the carriage and into the slot.

8. The machine of claim 7 wherein the blade includes a sharp edge which is disposed coplanar with the guide member's slot and the track.

9. The machine of claim 8 wherein the sharp edge of the blade is inclined to the longitudinal axis of the track.

10. The machine of claim 9 wherein the inclined edge of the blade compresses the sheet material against a top face of the guide member as the blade moves across the pathway of the sheet material, and severs the sheet material.

11. A cushioning conversion machine for converting a sheet-like stock material into a cushioning product, said machine comprising a housing, a conversion assembly, and a manual severing assembly;

the housing defining a severing zone and having an outer perimeter formed at least partially by a pair of opposite transverse sides separated by a certain span;

the conversion assembly being operative to convert the sheet-like stock material into a three-dimensional strip of dunnage and including a feed assembly which advances the strip of dunnage through the severing zone and which is at least partially enclosed by the housing;

the severing assembly being operative to sever the strip of dunnage into sections of a desired length as it advances through the severing zone and including a handle and a severing member;

the severing member being enclosed by the housing and movable between a first position whereat the strip of dunnage may advance through the severing zone and a second position whereby the strip of dunnage is severed in the severing zone;

the handle having a distal end portion positioned outside of the housing for manual manipulation along a path which moves the severing member between the first and second positions; and the path of the handle being contained within the span of the transverse sides of the housing.

12. A cushioning conversion machine as set forth in claim 11 wherein the handle moves transversely with respect to the path of the strip of dunnage through the severing zone.

13. A cushioning conversion machine as set forth in claim 12 wherein the severing assembly further comprises a track and a carriage;

the track being mounted adjacent to the cutting zone and extending substantially perpendicular to the transverse sides;

the carriage being slidably mounted on the track for movement therealong;

the severing member and the handle being connected to the carriage so that movement of the distal portion of the handle along the path moves the carriage along the track and moves the severing member between the first and second positions.

14. A cushioning conversion machine as set forth in claim 13 wherein the severing member is a polygonal blade having a severing edge which is inclined relative to the track.

15. A method of making a cushioning product, said method comprising the steps of:

providing a sheet-like stock material, and using the cushioning conversion machine of claim 11 to convert the sheet-like stock material into a three-dimensional strip of dunnage and to sever the strip of dunnage into sections of a desired length.

16. A method as set forth in claim 15 wherein the sheet-like stock material is biodegradable, recyclable, and made from a renewable resource.

17. A method as set forth in claim 16 wherein the sheet-like stock material is Kraft paper.

18. A method as set forth in claim 17 wherein the sheet-like stock material comprises multiple plies of Kraft paper.

19. A method as set forth in claim 18 wherein the sheet-like stock material comprises a roll of one of two and three superimposed plies of Kraft paper.

20. A method as set forth in claim 19 wherein the stock material has a width of approximately 27 inches.

21. A method of making a cushioning product of a desired length, said method comprising the steps of supplying a stock material, converting the stock material into a three-dimensional strip of dunnage having a lesser density than the stock material and having pillow-like portions, and severing the strip of dunnage into a cushioning product of the desired length, wherein said severing step comprises the steps of:

providing a severing mechanism including a track extending in a plane transverse to a pathway of the stock material, a carriage mounted on the track for movement therealong, and a severing member mounted to the carriage for movement across the track and the pathway of the stock material; and moving the carriage across the track to sever the strip of dunnage.

22. A method of making a cushioning product of a desired length, said method comprising the steps of:

supplying a stock material;

converting the stock material into a three-dimensional strip of dunnage having a lesser density than the stock material; and severing the strip of dunnage into a cushioning product of the desired length;

wherein said severing step is performed in a severing zone defined by a housing having an outer perimeter formed at least partially by a pair of opposite transverse sides separated by a certain span and includes the steps of moving a severing member enclosed by the housing between a first position whereat the stock material may advance through the severing zone and a second position whereat the stock material is severed in the severing zone;

wherein said step of moving the severing member comprises the step of manually moving a handle having a distal end portion positioned outside the housing along a path contained within the span of the transverse sides of the housing.

23. A method of making a cushioning product of a desired length, said method comprising the steps of:

supplying a stock material;

converting the stock material into a three-dimensional strip of dunnage having a lesser density than the stock material; and severing the stock material;

wherein said converting step comprises advancing the stock material through a severing zone defined by a housing having an outer perimeter formed at least partially by a pair of opposite transverse sides separated by a certain span;

wherein said severing step includes the steps of moving a severing member enclosed by the housing between a first position whereat the stock material may advance through the severing zone and a second position whereat the stock material is severed in the severing zone;

wherein said step of moving the severing member comprises the step of manually moving a handle having a distal end portion positioned outside the housing along a path contained within the span of the transverse sides of the housing.

24. A method as set forth in claim 23 wherein said step of moving the severing member comprises the step of moving a carriage mounted for movement across a track which is mounted to the housing adjacent the cutting zone.

25. A cushioning conversion machine for converting sheet-like stock material into a relatively low density cushioning dunnage product, said machine comprising:

a frame defining a cutting zone;

a conversion assembly, at least partially mounted to the frame, which converts the stock material into a strip having a lesser density than the stock material; and a severing mechanism which severs the stock material into sections of a desired length;

wherein the conversion assembly includes a feed mechanism which advances the stock material through the cutting zone along a pathway;

wherein the severing mechanism comprises a track, a carriage mounted on the track for movement therealong, and a severing member mounted to the carriage for movement across the track and the pathway;

the track being mounted to the frame adjacent cutting zone and extending in a plane transverse to the pathway.

26. The machine of claim 25 wherein the severing mechanism includes a reaction member mounted to the frame adjacent the cutting zone and generally parallel to the track and on the opposite side of the pathway from the track.

27. The machine of claim 25 wherein the carriage includes a manually engageable handle to move the carriage across the track.

28. A cushioning conversion machine for converting sheet-like stock material into a relatively low density cushioning dunnage product, said machine comprising:

a frame defining a cutting zone;

a conversion assembly, at least partially mounted to the frame, which converts the stock material into a strip having a lesser density than the stock material; and a severing mechanism which severs the stock material into sections of a desired length;

wherein the conversion assembly includes a feed mechanism which advances the stock material through the cutting zone along a pathway;

wherein the severing mechanism comprises a track, a carriage mounted on the track for movement therealong, and a severing member mounted to the carriage for movement across the track and the pathway;

the track being mounted to the frame adjacent cutting zone and extending in a plane transverse to the pathway;

the carriage including a manually engageable handle to move the carriage across the track; and the severing mechanism including a guide member mounted to the frame and positioned parallel to the rail and below the pathway, wherein the guide members has a longitudinal slot and the severing member extends downward from the carriage and into the slot.

29. The machine of claim 27 wherein the frame forms part of a housing which encloses severing member and wherein the handle includes a distal end portion positioned outside of the housing.

30. The machine of claim 29 wherein the housing has an outer perimeter formed at least partially by a pair of opposite transverse sides separated by a certain span and wherein the handle moves along a path contained within the span of the transverse sides of the housing.

* * * * *